United States Patent [19]

Samuelson

[11] 4,406,735

[45] Sep. 27, 1983

[54] PROCESS FOR ALKALINE OXYGEN GAS BLEACHING OF CELLULOSE PULP

[75] Inventor: Hans O. Samuelson, Gothenburg, Sweden

[73] Assignee: Mo och Domsjo Aktiebolag, Ornskoldsvik, Sweden

[21] Appl. No.: 267,968

[22] Filed: May 27, 1981

[30] Foreign Application Priority Data

May 27, 1980 [SE] Sweden ..... 8003911-8

[51] Int. Cl.[3] ..... D21C 3/16; D21C 9/10

[52] U.S. Cl. ..... 162/40; 162/65; 162/81

[58] Field of Search ..... 162/19, 65, 90, 81, 162/60, 79, 38, 40, 43, 44, 24, 25

[56] References Cited

U.S. PATENT DOCUMENTS

| | | | |
|---|---|---|---|
| 4,076,579 | 2/1978 | Brink | 162/81 |
| 4,087,318 | 5/1978 | Samuelson | 162/65 |

FOREIGN PATENT DOCUMENTS

| | | | |
|---|---|---|---|
| 1070909 | 2/1980 | Canada . | |
| 2717257 | 11/1977 | Fed. Rep. of Germany | 162/81 |
| 642399 | 1/1979 | U.S.S.R. | 162/81 |

*Primary Examiner*—Steve Alvo

[57] ABSTRACT

A process is provided for the bleaching delignification of cellulose pulp with oxygen gas in the presence of alkali, wherein the pulp is first activated with nitrogen dioxide and then washed, preferably with water. The invention is characterized in that the acid solution obtained is used to pretreat the digested pulp subsequent to washing the pulp with waste liquor obtained from the oxygen gas bleaching delignification stage.

23 Claims, 1 Drawing Figure

PROCESS FOR ALKALINE OXYGEN GAS BLEACHING OF CELLULOSE PULP

Figure 1:
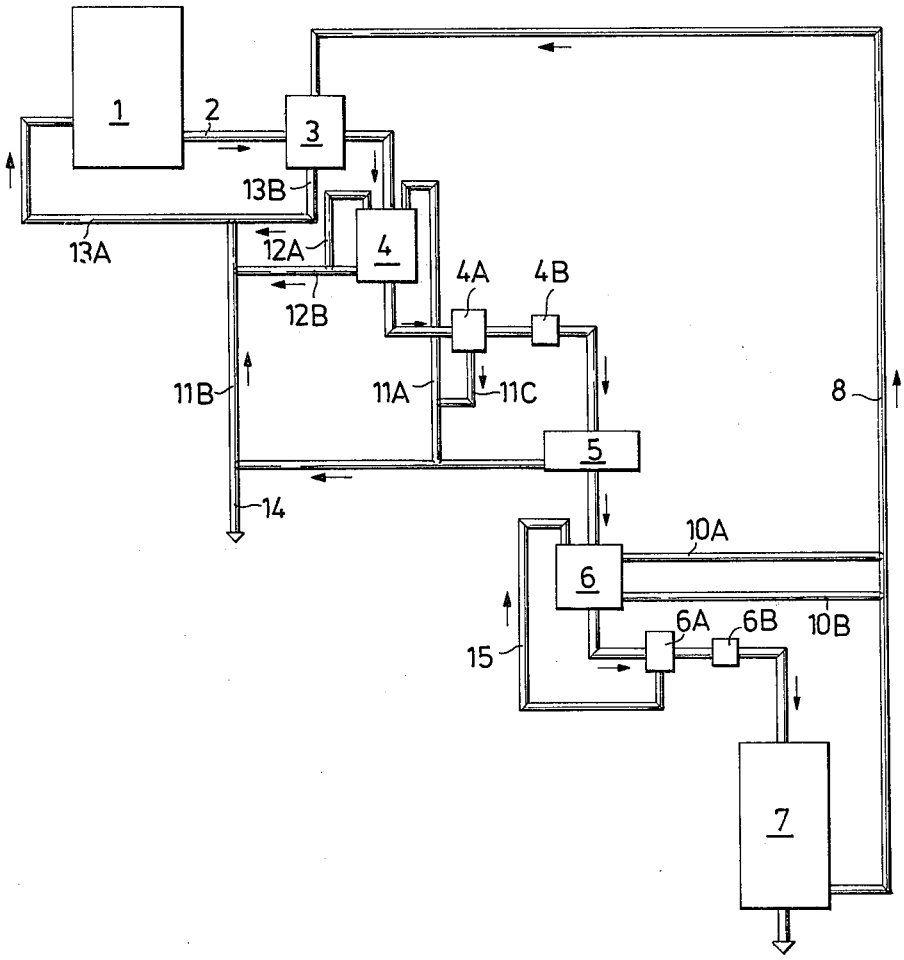

In the delignification of cellulose pulp by alkaline oxygen gas bleaching, the pulp is impregnated with sodium hydroxide, and is then treated with oxygen gas under pressure at a temperature of about 100° C. for normally about thirty minutes. Magnesium compounds are added in order to protect the carbohydrates against excessive degradation. Despite this, the delignification can only be carried to a stage where about 50% of the lignin remaining in the pulp after the digestion process has been removed. After that, the degradation of the carbohydrates becomes so great as to seriously impair the strength properties of the pulp.

In the case of sulfate pulp produced from softwood, such as pine, the pulp at the start of the oxygen gas bleaching has a lignin content corresponding to a Kappa number of from about 30 to about 40, which is reduced to from about 15 to about 20 during the delignification. The remaining lignin has to be removed by treating the pulp with chlorine, alkali and chlorine dioxide.

It is well known that chlorine-containing bleaching agents give rise to chlorinated aromatic substances, and bioaccumulatable chlorinated substances during the bleaching. If these are discharged with waste bleaching liquor into streams and lakes, they are taken up by fish. These substances cannot be destroyed by biological purification of the sewage water. Some chlorinated byproduct substances have been found to be mutagens.

Consequently, disposal of chlorine-containing waste bleaching liquor from bleaching plants constitutes a very serious problem. Efforts have been made to reduce the use of free or elementary chlorine in the bleaching of cellulose pulp by use of chlorine dioxide instead. The production of chlorine dioxide requires about three times as much electrical energy per kilogram of active chlorine as elementary chlorine.

Nitrogen dioxide has also been proposed in the bleaching delignification of cellulose pulp, and has been studied systematically by, among others, Clarke (*Paper Trade Journal, Tappi Sect.* 118 62 (1944)). However, in those methods where nitrogen dioxide has been tested, carbohydrates in the pulp have been degraded to such an extent as to preclude its use.

The delignification of lignocellulosic material by treatment with nitrogen dioxide, followed by washing with water, treatment with alkali, and subsequent treatment with oxygen gas, has also been proposed in Swedish patent application No. 77 05136-5. However, this technique has not been put into commercial practice.

Thus, in summary, alkaline oxygen gas bleaching delignification is outstanding in permitting burning of waste liquor from the bleaching plant while maintaining good economy, even though it has not been possible to remove more than about half of the lignin remaining in the pulp after digestion.

The present invention resolves these problems by providing a process for bleaching delignification of chemically digested cellulose pulp with oxygen gas in the presence of alkali after activating the pulp with nitrogen dioxide and washing the activated pulp with water and/or a dilute aqueous solution which comprises removing from the pulp digestion liquor by treating the pulp with waste liquor from the oxygen gas bleaching delignification; pretreating the resulting pulp with acid wash liquor recovered from washing the pulp after the activating stage; activating the pretreated pulp with nitrogen dioxide; washing the activated pulp with water and/or a dilute aqueous solution; subjecting the washed pulp to bleaching delignification with oxygen gas in the presence of alkali; and recovering the resulting bleaching delignified pulp.

Quite surprisingly, the introduction of this pretreatment stage with acid wash liquor from the activating stage makes it possible to recycle large quantities of oxygen gas bleaching waste liquor to the oxygen gas bleaching stage. Also, this recycling of oxygen gas bleaching waste liquor results in an improved selectivity during the oxygen gas bleaching stage, i.e., a lesser degree of depolymerization of the carbohydrates, in comparison with the same degree of removal of the lignin. Consequently, in a preferred embodiment subsequent to washing out part, preferably a major part, of the acid reaction products from the activated pulp, the pulp is impregnated with waste liquor from the oxygen gas bleaching stage before being subjected to the oxygen gas bleaching stage.

This effect seems to be due to the fact that organic substances present in the waste oxygen gas bleaching liquor can promote, either directly or indirectly, delignification of the activated and pretreated pulp without appreciably affecting the extent to which the carbohydrates are degraded.

The process of the invention is applicable to chemical cellulose pulps of all types, and in particular to alkaline digested chemical pulps. It is also possible to apply the invention to sulfite pulp. Examples of alkaline digested pulps are sulfate pulp, polysulfide pulp and soda pulp. The term "soda pulp" as used herein includes pulps which are digested with sodium hydroxide as the digestion chemical in the presence of various additives. Examples of such additives are redox catalysts, such as anthraquinone.

In the process of the invention, pulp having a Kappa number below 4 can be manufactured with good strength properties, and when such is required for environmental reasons this is the preferred application of the invention. The majority of unbleached pulps, if they are to be bleached to a Kappa number which is less than 4, require certain additives if the yield and strength properties are not to be seriously affected.

When a high degree of brightness is desired, for example, a brightness of 90% according to ISO, the pulp after bleaching with oxygen in accordance with the invention can be subjected to a final treatment with chlorine dioxide, in a single stage, or in two stages, with an intermediate extraction stage. If local conditions permit, for example in the case of systems where liquors having a high chloride content can be burned, the pulp can also be finally bleached with successive chlorine and alkali extraction stages, and optionally with other known bleaching agents, such as hypochlorite. The final bleaching stage can also be carried out with the use of peroxides and ozone.

If delignification is to be carried out to a lesser extent, for example to a Kappa number of from about 6 to about 10, the oxygen gas bleaching delignification stage according to the method of the invention can, in the case of many unbleached pulps, be effected with only oxygen and alkali, for example, sodium hydroxide, sodium carbonate, sodium hydrogen carbonate, and/or oxidized white liquor.

FIG. 1 is a flow sheet showing a preferred embodiment of the process according to the invention.

Nitrogen dioxide $NO_2$ exists as a dimer as $N_2O_4$, and possibly in larger units, all of which are in equilibrium with each other, and are collectively referred to herein as nitrogen dioxide. The nitrogen dioxide is suitably introduced in gas form.

Nitrogen dioxide can be produced by burning ammonia with oxygen gas or air, or in any other known manner. The gaseous mixture resulting from this combustion process can be used directly for bleaching purposes, preferably subsequent to being cooled somewhat. The nitrogen dioxide can also be added in liquid form, which may be more convenient when the nitrogen dioxide is not manufactured on the site.

Activation with nitrogen dioxide is suitably carried out at a pulp concentration with the range from about 20 to about 50%, and the amount of nitrogen dioxide charged is within the range from about 0.2 to about 5% by weight based on the bone dry weight of the pulp. The pulp concentration most suitably is above 27%, and from 27% up to the highest concentration which can be reached with a press, for example, 40%. If, as is preferred, the pulp is pressed prior to the activating stage, the pulp is suitably broken up (fluffed) in a known manner before it is subjected to the activating stage.

Activation of the pulp can be carried out at room temperature, although activation is accelerated at elevated temperatures, for example, at temperatures within the range from about 40° to about 80° C. Higher temperatures may also be used.

The pulp is preferably activated over a reaction time of from 5 to 250 seconds. When working at high temperatures, for example, temperatures in the region of 80° to 100° C., the reaction time is preferably short, and does not exceed 250 seconds. When working at lower temperatures, a reaction time longer than 250 seconds can be used, for example, from 5 to 30 minutes, before the soluble reaction products formed in the activating stage are washed out.

During activation of the pulp an intimate contact is maintained between the cellulose pulp and the nitrogen dioxide. In a continuous process, the pulp can be advanced on a vibratory table, or in a rotary drum, or in a reactor vessel provided with arms, scrapers or other mechanical devices suitable for advancing and mixing the pulp. Prior to introducing the pulp to the activating zone, the pulp is suitable subjected to a vacuum.

The pretreatment stage, including treating the pulp with waste liquor from the activating stage, is conveniently carried out at a pulp consistency within the range from about 1 to about 20%, at a temperature within the range from about 20° to about 80° C. for a reaction period within the range for example, from about 5 to about 60 minutes. A shorter reaction time period, less than 1 minute, has been found to give a positive effect. For unknown reasons, a markedly increased effect has been obtained in the case of certain pulps when reaction time has been extended to thirty minutes at a temperature, for example, of 30° C. At high temperatures, the contact time must be of such short duration that no appreciable acid hydrolysis occurs. The conditions should therefore be so selected and controlled that lowering of the viscosity of the pulp in this stage is insignificant. When manufacturing paper pulps, which must meet a high strength requirement, a reduction in the intrinsic viscosity of the pulp that is greater than 5% should be avoided. In order to delignify the pulp to a Kappa number below 5 subsequent to the oxygen gas stage, without the strength properties of the resultant pulp being jeopardized, or the costs of the additive chemicals being prohibitive to the practical application of the invention, it is necessary that the pretreatment stage be carried out thoroughly and correctly.

Normally, the waste liquor obtained from the pretreatment stage is removed by filtration, and/or by other known methods of pulp concentration, for example, by pressing the pulp. As will be understood, the surplus pretreatment liquor can be conveniently returned to the pretreatment stage. If so desired, that pretreatment liquor which adheres to the pulp can be displaced therefrom or washed out with water and/or an aqueous solution before subjecting the pulp to continued treatment in accordance with the invention, for example before treating the pulp with nitrogen dioxide.

Despite the fact that the oxygen gas bleaching waste liquor contains many organic compounds which form complexes with divalent or trivalent metal ions, such as calcium, magnesium, manganese, copper and iron, present in the system, it has been found suitable to introduce to the pulp one or more chelating or complexing agents for transition metals, such as aminopolyphosphonic acids, aminopolycarboxylic acids, or other complexing agents which are inert to the process prior to and/or during the oxygen gas stage. The introduction of complexing agents in conjunction with the oxygen gas bleaching delignification stage is often carried out in a manner such that the complexing agent and the chelates or complex metal compounds formed thereby are present during the oxygen gas bleaching delignification. In the case of pulps studied hitherto it has been found more advantageous to use complexing agents which are inert to the process in accordance with the method of the invention to remove any complexed transition metal compounds by filtration and/or washing, prior to the oxygen gas bleaching delignification stage. Even when these complex compounds are removed prior to the oxygen gas bleaching delignification stage, it may be justified to subsequently add thereto further complexing agents so that a suitable complexing agent concentration is present during the oxygen gas bleaching delignification stage.

Normally, the maximum effect of a small amount of complexing agent, for example 0.1 kg/ton of pulp, is obtained in the method according to the invention when the addition is made in a slightly acid medium during or after the activating stage, preferably after the major part of the waste liquor from the activating stage is removed from the pulp, and any metal complexes that are formed are separated from the pulp prior to the oxygen gas stage.

If the oxygen gas delignification is to be continued to a Kappa number below 6, it is often necessary to add a larger quantity of complexing agents, for example, an amount within the range from about 0.2 to about 1 kg/ton of pulp. Even larger amounts of complexing agents can be employed, provided they are inert to the process. Addition of complexing agents can also suitably be made at other stages in the process, preferably such that complexes of, for example, manganese, are separated from the pulp (including the accompanying liquor) before the pulp enters the oxygen gas reactor vessel, and so that only complexing agents containing ligands not bound to transition metals are present during the oxygen gas delignification stage.

The complexing agent should be supplied to the pulp in solution at a pH below 7.5, suitable below 6, and preferably within the range from about 1 to about 4. The complex-forming reactions can be allowed to proceed for a short period of time, for example, for one minute, although improved selectivity can often be observed when the time for the treatment is extended to, for example, from 30 to 90 minutes. When the treatment is started at a pH of from 1 to 4, it is advantageous to increase the pH to within the range from about 6 to about 9 after a short period, for example, a period which embraces 10% of the total complex-forming reaction time. The complexing process with complexing agents is suitably effected at a temperature within the range from about 20° to about 100° C., preferably from 20° to 60° C. When a low pH is used, for example, a pH of 1 to 3, the time and temperature must be so adjusted that no appreciable reduction in pulp viscosity is obtained.

At least one complexing agent should be added that provides manganese complexes which at a pH 9 have a stability constant which is at least 1000, preferably at least 10,000 times, greater than the corresponding stability constant for any magnesium complexes present.

Particularly advantageous results have been obtained when using complexing agents containing at least one and preferably three nitrogen atoms, and at least two and preferably five phosphonic acid groups. Suitable compounds have several nitrogen atoms, each of which is bound to two or three methylene groups. Aminomethylenephosphonic acids can be used to advantage. Particularly good results have been obtained when using diethylenetriamine pentamethylene phosphonic acids.

Other groups of complexing agents that can be used are those used in conventional oxygen gas bleaching delignification processes. For example, polyaminopolycarboxylic acids, such as ethylenediamine tetraacetic acid, and preferably diethylenetriamine pentaacetic acid, are quite satisfactory, particularly if the major part of the complexes formed with transition metals are removed prior to the oxygen gas bleaching delignification stage. The complexing agents can be added in the form of free acids or salts, for example, in the form of sodium salts, or magnesium salts.

It is normal procedure in conventional oxygen gas bleaching delignification processes to add magnesium compounds, in order to protect the carbohydrates from excessive degradation. Additions of magnesium compounds are also advantageous when carrying out the process according to the invention, although the activation and pretreatment of the pulp has a substantially greater protective effect. If the pretreatment process is effective, it is possible, without noticeable disadvantage, to omit magnesium compounds, at least when complexing agents are added, as described above.

Selectivity in the process of the present invention is greatly improved by the introduction of complexing agents.

The complexing agents which are added and the complexing agents formed in situ during the treatment of the cellulose pulp influence the process according to the invention in many different ways. Consequently, it has been impossible to establish those reactions which facilitate the extensive delignification of the pulp without seriously affecting the degradation of the cellulose.

While providing the advantages noted above, the complexing agents also have disadvantages, for example, the removal of manganese compounds, which are delignification catalysts, and which are also protectors against cellulose degradation, such as manganese hydroxide. That under certain conditions manganese compounds effectively protect carbohydrates against degradation in oxygen gas bleaching delignification processes is described by Manoucheri and Samuelson, *Svensk Papperstidning* 80 (1977), 381, and International Paper's Swedish patent application No. 76 01935-8.

Despite this, it has been found that the best selectivity in the process of the invention is obtained when the manganese content of the pulp is reduced from the usual amount of from 70 to 150 mg Mn per kg pulp to less than 4 mg per kg (measured in the oxygen gas bleached pulp). Under comparable treatment conditions, selectivity decreases as manganese content of the oxygen gas bleached pulp increases. From the results it cannot be said that the effect is directly proportional to the manganese content. However, when optimizing the process for different starting pulps, it has been found that a marked improvement in selectivity can be obtained when a large quantity of manganese is removed from the pulp at the earliest possible stage of the process.

It is known that formaldehyde reacts with peroxide formed during the oxygen gas bleaching delignification process, to form formate ions and hydrogen gas. This means that, in conventional oxygen gas bleaching delignification processes, reactions between peroxide and transition metal compounds which give rise to free radicals are suppressed. This decreases the depolymerization of the cellulose. Tests have shown that although these disturbing reactions are less apparent in the process of the invention, formaldehyde not only retards the degradation of the cellulose, but also the delignification, although the net result is an improved selectivity. Hence, addition of formaldehyde can be advantageous under certain conditions.

The greatest effect of formaldehyde, using an addition of 0.5%, based on the dry weight of the pulp, has been obtained when the addition is made prior to the oxygen gas bleaching delignification stage. Paraformaldehyde or other known products which produce formaldehyde can be used, as well as formaldehyde. Hydrogen gas is formed as a byproduct, and can be removed from the reactor vessel by, for example, converting the gas catalytically to water, in known manner.

If a pulp with a very low lignin content is desired, this can be achieved by repeating the process of the invention one, two, or more times. When the two-stage process according to the invention is represented by the shorthand code $NO_2+O_2$, such pulp is obtained with the double sequence $NO_2+O_2+NO_2+O_2$. Triple, quadruple and more repeats can be used, if necessary.

Oxygen gas bleaching delignification of the pulp can be carried out at a pulp consistency within the range from about 1 to about 40%, suitably from 8 to 35%, preferably from 27 to 34%.

The total alkali addition can be within the range from about 1 to about 10%, calculated as NaOH, and based on the weight of the pulp. It has been found particularly advantageous to use a low alkali addition in the oxygen gas bleaching delignification stage, for example, an addition in the order of 1.5 and at most 3% NaOH, and to return oxygen gas waste liquor to the oxygen gas stage.

Conveniently, a longer than normal treatment time is used for the oxygen gas bleaching delignification stage, for example, a time within the range from about 60 to about 500 minutes, suitably from 90 to 300 minutes, preferably from 90 to 180 minutes.

The treatment temperature in the oxygen gas bleaching delignification stage is within the range from about 90° to about 135° C., suitably from 100° to 130° C., preferably 100° to 115° C. When formaldehyde is added to the system, the preferred temperature is within the range from 115° to 130° C. Despite the fact that formaldehyde has been found to retard delignification during oxygen gas bleaching delignification according to the invention, the treatment time can be shortened somewhat by applying higher temperatures.

The process of the invention makes it possible to lower the Kappa number of the pulp considerably in the bleaching stage by using chemicals which are relatively inexpensive, and which give rise to waste liquors which can be rendered innocuous by burning, which need not be dumped. Combustion of these waste liquors can be integrated with the combustion of the cooking waste liquor, without providing special arrangements for ejecting chloride from the system. Thus, the invention provides a bleaching delignification process using primarily oxygen gas, which is an inexpensive and innocuous bleaching chemical. Since the amount of lignin which remains in the pulp after the treatment in accordance with the invention is low, the amount of chlorine-containing bleaching agent required for finally bleaching the pulp is much lower than in previously known bleaching methods. Consequently, the waste discharges from the pulp manufacturing plant are reduced.

The following Examples represent preferred embodiments of the invention.

EXAMPLE 1

The process in this Example followed the flow sheet shown in FIG. 1.

Pine pulp which had been digested by the polysulfide process in the digester designated 1 was conveyed through the conduit 2, which runs through the whole plane, to first and second pretreatment vessels 3, 4. The pulp was then passed to an activating reactor 5, and then to a storage vessel 6, whence it was withdrawn into bleaching tower (oxygen gas reactor) 7. In the activating reactor 5 the pulp was reacted with nitrogen dioxide, $NO_2$, while in the bleaching tower 7 the pulp was subjected to oxygen gas bleaching delignification while immersed in an alkaline liquor.

The pine chips were digested in the digester 1 to a pulp having a Kappa number of 28 in accordance with the polysulfide method. Elementary or free sulphur calculated at 2% on the dry weight of the wood was added to the alkaline pulping liquor. In the pretreatment vessel 3, the pulp was washed with waste oxygen gas bleaching liquor, obtained from the oxygen gas reactor vessel 7, thereby forcing the major part of the black liquor out of the pulp. The waste liquor from the oxygen gas reactor 7 was conveyed through the main line 8 to the treatment vessel 3. Part of the waste liquor was conveyed through a branch line 10A via the treatment vessel 6 and a line 10B back to the main line 8.

The pulp was passed from the treatment vessel 3 to the treatment vessel 4, where it was initially washed with waste liquor from previously treated pulp in this stage, the waste liquor being supplied through the line 12A, whereupon the pulp was treated with acid waste liquor obtained from the activating stage 5, supplied through a line 11A. The pulp was reacted with this waste liquor for fifteen minutes at a temperature of 35° C. In this pretreatment stage the pulp had a concentration of 6% and a pH of 2.0.

The pulp was passed from the vessel 4 to a dewatering device 4A comprising a filter and a press, by which the pulp concentration was raised to 42%. The recovered waste liquor was recirculated to the treatment vessel 4, into contact with newly supplied pulp through the pipe 11C.

The pressed pulp was fluffed in a peg shredder 4B, and was introduced into the activating reactor 5. The reactor vessel had the form of a horizontal cylinder, provided with a coaxial rotary screw shaft provided with helical blades, the purpose of which was to provide effective contact between the fluffed pulp and the gas phase, and to progressively advance the pulp through the reactor. The reactor was placed under vacuum, and gaseous nitrogen dioxide (obtained by vaporizing liquid nitrogen dioxide) was fed to four nozzles arranged along the length of the reactor vessel. Nitrogen dioxide was introduced for thirty seconds, and the reaction was continued for two hundred seconds, after which the introduction of nitrogen dioxide was terminated. The temperature was 60° C. and the amount of nitrogen dioxide added was 2%, based on the dry weight of the pulp.

The pulp was then washed with water. The waste liquor recovered from the activating stage 5 was returned to the system, for use in the pretreatment stage 4, as described. Surplus acid waste liquor from the activating stage 5 and waste liquor returned from the pretreatment stage 4 were passed back to the system through the line 11B and the line 12B. One part of this liquor was passed to the line 13A, and then to the digester 1, for the purpose of displacing black liquor from the pulp, and the other part of the liquor was conveyed through the branch line 14 to another stage in the pulp manufacturing process.

After removing from the pulp the major part of the liquor from the activating stage reactor 5, the pulp was impregnated with oxygen gas bleaching waste liquor obtained from oxygen gas stage reactor 7. In addition, the pulp was impregnated with aqueous magnesium sulfate, and then with aqueous sodium hydroxide. The pulp suspension was concentrated in a dewatering apparatus 6A, comprising a filter and a press, to a concentration of 29%, and fluffed in a peg shredder 6B. The amounts of sodium hydroxide and magnesium sulfate added were so adjusted that the pressed pulp contained 0.1% magnesium and 2% sodium hydroxide, based on the dry weight of the pulp.

The liquor obtained when concentrating the pulp on the filter and in the press was returned via line 15 to the treatment vessel 6 for impregnating the activated pulp. The surplus recovered liquor was passed via the line 10B and the main line or conduit 8 to the treatment vessel 3, for displacing the black liquor in the unbleached pulp, as previously indicated.

The pulp was subjected to oxygen gas bleaching delignification in the reactor 7 at a temperature of 106° C. and at a partial pressure of oxygen gas of 0.7 MPa for ninety minutes. The Kappa number of the delignified bleached pulp was 6.1. The pulp was diluted with waste liquor previously recovered from the oxygen gas bleaching delignification reactor 7. The oxygen gas bleaching waste liquor recovered from subsequent washings was used in the manner shown in the FIGURE, and previously described.

By way of comparison, a similar polysulfide pulp was oxygen gas bleached in the conventional manner at a temperature of 106° C. and at an oxygen gas partial pressure of 0.6 MPa for sixty minutes. The alkali addition comprised 1.7% sodium hydroxide, and the amount of magnesium sulfate added was 0.1%, based on the dry weight of the pulp. The Kappa number of the bleached pulp was 14. The pulp was then subjected to continued bleaching in accordance with the sequence chlorine dioxide plus alkali extraction, thereby obtaining a pulp having a Kappa number of 6. The chlorine dioxide stage was carried out a pulp concentration of 12%, a temperature of 40° C., and a chlorine dioxide addition of 2.1%, calculated as active chlorine on the dry weight of the pulp, for thirty minutes. The extraction stage was effected at a pulp concentration of 12%, a temperature of 55° C., and a sodium hydroxide addition of 0.9%, based on the dry weight of the pulp, for sixty minutes.

Paper was manufactured in the laboratory from the two pulps produced, in accordance with a standard paper making method. Tests made on the tensile strength, the tear strength and the burst index of the paper showed that the pulp produced in accordance with the invention gave, in the main, the same values as the comparison pulp.

This shows that it is possible by the process of the invention to produce a cellulose pulp having a relatively low lignin content and exhibiting good strength properties without the use of chlorine-containing bleaching agents.

EXAMPLE 2

The process in this Example followed the flow sheet shown in FIG. 1.

Pine pulp which has been digested by the polysulfide process in the digester designated 1 was conveyed through the conduit 2, which runs through the whole plant, to first and second pretreatment vessels 3, 4. The pulp was then passed to an activating reactor 5, and then to a storage vessel 6, whence it was withdrawn into bleaching tower (oxygen gas reactor) 7. In the activating reactor 5 the pulp was reacted with nitrogen dioxide, $NO_2$, while in the bleaching tower 7 the pulp was subjected to oxygen gas bleaching delignification while immersed in an alkaline liquor.

The pine chips were digested in the digester 1 to a pulp having a Kappa number of 28 in accordance with the polysulfide method. Elementary or free sulphur calculated at 2% on the dry weight of the wood was added to the alkaline pulping liquor. In the pretreatment vessel 3, the pulp was washed with waste oxygen gas bleaching liquor, obtained from the oxygen gas reactor vessel 7, thereby forcing the major part of the black liquor out of the pulp. The waste liquor from the oxygen gas reactor 7 was conveyed through the main line 8 to the treatment vessel 3. Part of the waste liquor was conveyed through a branch line 10A via the treatment vessel 6 and a line 10B back to the main line 8.

The pulp was passed from the treatment vessel 3 to the treatment vessel 4, where it was initially washed with waste liquor from previously treated pulp in this stage, the waste liquor being supplied through the line 12A, whereupon the pulp was treated with acid waste liquor obtained from the activating stage 5, supplied through a line 11A. The pulp was reacted with this waste liquor for fifteen minutes at a temperature of 35° C. In this pretreatment stage the pulp had a concentration of 6% and a pH of 2.0.

The pulp was passed from the vessel 4 to a dewatering device 4A comprising a filter and a press, by which the pulp concentration was raised to 42%. The recovered waste liquor was recirculated to the treatment vessel 4, into contact with newly supplied pulp through the pipe 11C.

The pressed pulp was fluffed in a peg shredder 4B, and was introduced into the activating reactor 5. The reactor vessel had the form of a horizontal cylinder, provided with a coaxial rotary screw shaft provided with helical blades, the purpose of which was to provide effective contact between the fluffed pulp and the gas phase, and to progressively advance the pulp through the reactor. The reactor was placed under vacuum, and gaseous nitrogen dioxide (obtained by vaporizing liquid nitrogen dioxide) was fed to four nozzles arranged along the length of the reactor vessel. Nitrogen dioxide was introduced for thirty seconds, and the reaction was continued for two hundred seconds, after which the introduction of nitrogen dioxide was terminated. The temperature was 60° C. and the amount of nitrogen dioxide added was 2%, based on the dry weight of the pulp.

The pulp was then washed with water. The waste liquor recovered from the activating stage 5 was returned to the system, for use in the pretreatment stage 4, as described. Surplus acid waste liquor from the activating stage 5 and waste liquor returned from the pretreatment stage 4 were passed back to the system through the line 11B and the line 12B. One part of this liquor was passed to the line 13A, and then to the digester 1, for the purpose of displacing black liquor from the pulp, and the other part of the liquor was conveyed through the branch line 14 to another stage in the pulp manufacturing process.

After removing from the pulp the major part of the liquor from the activating stage reactor 5, the pulp was impregnated with oxygen gas bleaching waste liquor obtained from oxygen gas stage reactor 7. In addition, the pulp was impregnated with aqueous magnesium sulfate, and then with aqueous sodium hydroxide. The pulp suspension was concentrated in a dewatering apparatus 6A, comprising a filter and a press, to a concentration of 29%, and fluffed in a peg shredder 6B. The amounts of sodium hydroxide and magnesium sulfate added were so adjusted that the pressed pulp contained 0.1% magnesium and 2.5% sodium hydroxide, based on the dry weight of the pulp.

The liquor obtained when concentrating the pulp on the filter and in the press was returned via line 15 to the treatment vessel 6 for impregnating the activated pulp. The surplus recovered liquor was passed via the line 10B and the main line or conduit 8 to the treatment vessel 3, for displaciang the black liquor in the unbleached pulp, as previously indicated.

The pulp was subjected to oxygen gas bleaching delignification in the reactor 7 at a temperature of 106° C. and at a partial pressure of oxygen gas of 0.7 MPa for ninety minutes. The Kappa number of the delignified bleached pulp was 3. The pulp was diluted with waste liquor previously recovered from the oxygen gas bleaching delignification reactor 7. The oxygen gas bleaching waste liquor recovered from subsequent washings was used in the manner shown in the FIGURE, and previously described.

By way of comparison, a similar polysulfide pulp was oxygen gas bleached in the conventional manner at a temperature of 106° C. and at an oxygen gas partial pressure of 0.6 MPa for sixty minutes. The alkali addition comprised 1.7% sodium hydroxide, and the amount of magnesium sulfate added was 0.1%, based on the dry weight of the pulp. The Kappa number of the bleached pulp was 14. The pulp was then subjected to continued bleaching in accordance with the sequence chlorine dioxide plus alkali extraction, thereby obtaining a pulp having a Kappa number of 6. The chlorine dioxide stage was carried out at a pulp concentration of 12%, a temperature of 40° C., and a chlorine dioxide addition of 2.1%, calculated as active chlorine on the dry weight of the pulp, for thirty minutes. The extraction stage was effected at a pulp concentration of 12%, a temperature of 55° C., and a sodium hydroxide addition of 0.9%, based on the dry weight of the pulp, for sixty minutes.

Paper was manufactured in the laboratory from the two pulps produced, in accordance with a standard paper making method. Tests made on the tensile strength, the tear strength and the burst index of the paper showed that the pulp produced in accordance with the invention was reduced by from 10% to 15% as compared to the comparison pulp.

This shows that it is possible by the process of the invention to produce a cellulose pulp having a relatively low lignin content and exhibiting good strength properties without the use of chlorine-containing bleaching agents.

EXAMPLE 3

The process in this Example followed the flow sheet shown in FIG. 1.

Pine pulp which had been digested by the polysulfide process in the digester designated 1 was conveyed through the conduit 2, which runs through the whole plant, to first and second pretreatment vessels 3, 4. The pulp was then passed to an activating reactor 5, and then to a storage vessel 6, whence it was withdrawn into bleaching tower (oxygen gas reactor) 7. In the activating reactor 5 the pulp was reacted with a nitrogen dioxide, $NO_2$, while in the bleaching tower 7 the pulp was subjected to oxygen gas bleaching delignification while immersed in an alkaline liquor.

The pine chips were digested in the digester 1 to a pulp having a Kappa number of 28 in accordance with the polysulfide method. Elementary or free sulphur calculated at 2% on the dry weight of the wood was added to the alkaline pulping liquor. In the pretreatment vessel 3, the pulp was washed with waste oxygen gas bleaching liquor, obtained from the oxygen gas reactor vessel 7, thereby forcing the major part of the black liquor out of the pulp. The waste liquor from the oxygen gas reactor 7 was conveyed through the main line 8 to the treatment vessel 3. Part of the waste liquor was conveyed through a branch line 10A via the treatment vessel 6 and a line 10B back to the main line 8.

The pulp was passed from the treatment vessel 3 to the treatment vessel 4, where it was initially washed with waste liquor from previously treated pulp in this stage, the waste liquor being supplied through the line 12A, whereupon the pulp was treated with acid waste liquor obtained from the activating stage 5, supplied through a line 11A. The pulp was reacted with this waste liquor for fifteen minutes at a temperature of 35° C. In this pretreatment stage the pulp had a concentration of 6% and a pH of 2.0.

The pulp was passed from the vessel 4 to a dewatering device 4A comprising a filter and a press, by which the pulp concentration was raised to 42%. The recovered waste liquor was recirculated to the treatment vessel 4, into contact with newly supplied pulp through the pipe 11C.

The pressed pulp was fluffed in a peg shredder 4B, and was introduced into the activating reactor 5. The reactor vessel had the form of a horizontal cylinder, provided with a coaxial rotary screw shaft provided with helical blades, the purpose of which was to provide effective contact between the fluffed pulp and the gas phase, and to progressively advance the pulp through the reactor. The reactor was placed under vacuum, and gaseous nitrogen dioxide (obtained by vaporizing liquid nitrogen dioxide) was fed to four nozzles arranged along the length of the reactor vessel. Nitrogen dioxide was introduced for thirty seconds, and the reaction was continued for two hundred seconds, after which the introduction of nitrogen dioxide was terminated. The temperature was 60° C. and the amount of nitrogen dioxide added was 2%, based on the dry weight of the pulp.

The pulp was then washed with water. The waste liquor recovered from the activating stage 5 was returned to the system, for use in the pretreatment stage 4, as described. Surplus acid waste liquor from the activating stage 5 and waste liquor returned from the pretreatment stage 4 were passed back to the system through the line 11B and the line 12B. One part of this liquor was passed to the line 13A, and then to the digester 1, for the purpose of displacing black liquor from the pulp, and the other part of the liquor was conveyed through the branch line 14 to another stage in the pulp manufacturing process.

After removing from the pulp the major part of the liquor from the activating stage reactor 5, the pulp was impregnated for thirty minutes with an aqueous solution at pH 5 of diethylenetriamine pentamethylene phosphonic acid, so that 0.1% diethylenetriamine pentamethylene phosphonic acid, calculated on the dry weight of the pulp, was added. The pulp was then passed to the impregnating stage 6 and impregnated with oxygen gas bleaching waste liquor obtained from oxygen gas stage reactor 7. In addition, the pulp was impregnated with aqueous magnesium sulfate, and then with aqueous sodium hydroxide. The pulp suspension was concentrated in a dewatering apparatus 6A, comprising a filter and a press, to a concentration of 29%, and fluffed in a peg shredder 6B. The amounts of sodium hydroxide and magnesium sulfate added were so adjusted that the pressed pulp contained 0.2% magnesium and 2.5% sodium hydroxide, based on the dry weight of the pulp.

The liquor obtained when concentrating the pulp on the filter and in the press was returned via line 15 to the treatment vessel 6 for impregnating the activated pulp. The surplus recovered liquor was passed via the line 10B and the main line or conduit 8 to the treatment vessel 3, for displacing the black liquor in the unbleached pulp, as previously indicated.

The pulp was subjected to oxygen gas bleaching delignification in the reactor 7 at a temperature of 106° C. and at a partial pressure of oxygen gas of 0.7 MPa for ninety minutes. The Kappa number of the delignified bleached pulp was 3.2. The pulp was diluted with waste liquor previously recovered from the oxygen gas bleaching delignification reactor 7. The oxygen gas bleaching waste liquor recovered from subsequent washings was used in the manner shown in the FIGURE, and previously described.

By way of comparison, a similar polysulfide pulp was oxygen gas bleached in the conventional manner at a temperature of 106° C. and at an oxygen gas partial pressure of 0.6 MPa for sixty minutes. The alkali addition comprised 1.7% sodium hydroxide, and the amount of magnesium sulfate added was 0.1%, based on the dry weight of the pulp. The Kappa number of the bleached pulp was 14. The pulp was then subjected to continued bleaching in accordance with the sequence chlorine dioxide plus alkali extraction, thereby obtaining a pulp having a Kappa number of 6. The chlorine dioxide stage was carried out at a pulp concentration of 12%, a temperature of 40° C., and a chlorine dioxide addition of 2.1%, calculated as active chlorine on the dry weight of the pulp, for thirty minutes. The extraction stage was effected at a pulp concentration of 12%, a temperature of 55° C., and a sodium hydroxide addition of 0.9%, based on the dry weight of the pulp, for sixty minutes.

Paper was manufactured in the laboratory from the two pulps produced, in accordance with a standard paper making method. Tests made on the tensile strength, the tear strength and the burst index of the paper showed that the pulp produced in accordance with the invention gave, in the main, the same values as the comparison pulp.

This shows that it is possible by the process of the invention to produce a cellulose pulp having a relatively low lignin content and exhibiting good strength properties without the use of chlorine-containing bleaching agents.

EXAMPLE 4

The process in this Example followed the flow sheet shown in FIG. 1.

Pine pulp which had been digested by the polysulfide process in the digester designated 1 was conveyed through the conduit 2, which runs through the whole plant, to first and second pretreatment vessels 3, 4. The pulp was then passed to an activating reactor 5, and then to a storage vessel 6, whence it was withdrawn into bleaching tower (oxygen gas reactor) 7. In the activating reactor 5 the pulp was reacted with nitrogen dioxide, $NO_2$, while in the bleaching tower 7 the pulp was subjected to oxygen gas bleaching delignification while immersed in an alkaline liquor.

The pine chips were digested in the digester 1 to a pulp having a Kappa number of 28 in accordance with the polysulfide method. Elementary of free sulphur calculated at 2% on the dry weight of the wood was added to the alkaline pulping liquor. In the pretreatment vessel 3, the pulp was washed with waste oxygen gas bleaching liquor, obtained from the oxygen gas reactor vessel 7, thereby forcing the major part of the black liquor out of the pulp. The waste liquor from the oxygen gas reactor 7 was conveyed through the main line 8 to the treatment vessel 3. Part of the waste liquor was conveyed through a branch line 10A via the treatment vessel 6 and a line 10B back to the main line 8.

The pulp was passed from the treatment vessel 3 to the treatment vessel 4, where it was initially washed with waste liquor from previously treated pulp in this stage, the waste liquor being supplied through the line 12A, whereupon the pulp was treated with acid waste liquor obtained from the activating stage 5, supplied through a line 11A. The pulp was reacted with this waste liquor for fifteen minutes at a temperature of 35° C. In this pretreatment stage the pulp had a concentration of 6% and a pH of 2.0.

The pulp was passed from the vessel 4 to a dewatering device 4A comprising a filter and a press, by which the pulp concentration was raised to 42%. The recovered waste liquor was recirculated to the treatment vessel 4, into contact with newly supplied pulp through the pipe 11C.

The pressed pulp was fitted in a peg shredder 4B, and was introduced into the activating reactor 5. The reactor vessel had the form of a horizontal cylinder, provided with a coaxial rotary screw shaft provided with helical blades, the purpose of which was to provide effective contact between the fluffed pulp and the gas phase, and to progressively advance the pulp through the reactor. The reactor was placed under vacuum, and gaseous nitrogen dioxide (obtained by vaporizing liquid nitrogen dioxide) was fed to four nozzles arranged along the length of the reactor vessel. Nitrogen dioxide was introduced for thirty seconds, and the reaction was continued for two hundred seconds, after which the introduction of nitrogen dioxide was terminated. The temperature was 60° C. and the amount of nitrogen dioxide added was 2%, based on the dry weight of the pulp.

The pulp was then washed with water. The waste liquor recovered from the activating stage 5 was returned to the system, for use in the pretreatment stage 4, as described. Surplus acid waste liquor from the activating stage 5 and waste liquor returned from the pretreatment stage 4 were passed back to the system through the line 11B and the line 12B. One part of this liquor was passed to the line 13A, and then to the digester 1, for the purpose of displacing black liquor from the pulp, and the other part of the liquor was conveyed through the branch line 14 to another stage in the pulp manufacturing process.

After removing from the pulp the major part of the liquor from the activating stage reactor 5, the pulp was impregnated with oxygen gas bleaching waste liquor obtained from oxygen gas stage reactor 7. In addition, the pulp was impregnated with aqueous magnesium sulfate, and then with aqueous sodium hydroxide. The pulp suspension was concentrated in a dewatering apparatus 6A, comprising a filter and a press, to a concentration of 29%, and fluffed in a peg shredder 6B. The amounts of sodium hydroxide and magnesium sulfate added were so adjusted that the pressed pulp contained 0.1% magnesium and 2.5% sodium hydroxide, based on the dry weight of the pulp.

The liquor obtained when concentrating the pulp on the filter and in the press was returned via line 15 to the treatment vessel 6 for impregnating the activated pulp. The surplus recovered liquor was passed via the line 10B and the main line or conduit 8 to the treatment vessel 3, for displacing the black liquor in the unbleached pulp, as previously indicated.

Next, 0.5% formaldehyde calculated on the pulp dry weight, was added to the pulp, and then the pulp was introduced to the oxygen gas reactor 7.

The pulp was subjected to oxygen gas bleaching delignification in the reactor 7 at a temperature of 106° C. and at a partial pressure of oxygen gas of 0.7 MPa for 120 minutes. The Kappa number of the delignified bleached pulp was 3.5 The pulp was diluted with waste liquor previously recovered from the oxygen gas bleaching delignification reactor 7. The oxygen gas bleaching waste liquor recovered from subsequent washings was used in the manner shown in the FIGURE, and previously described.

By way of comparison, a similar polysulfide pulp was oxygen gas bleached in the conventional manner at a temperature of 106° C. and at an oxygen gas partial pressure of 0.6 MPa for sixty minutes. The alkali addition comprised 1.7% sodium hydroxide, and the amount of magnesium sulfate added was 0.1%, based on the dry weight of the pulp. The Kappa number of the bleached pulp was 14. The pulp was then subjected to continued bleaching in accordance with the sequence chlorine dioxide plus alkali extraction, thereby obtaining a pulp having a Kappa number of 6. The chlorine dioxide stage was carried out at a pulp concentration of 12%, a temperature of 40° C., and a chlorine dioxide addition of 2.1%, calculated as active chlorine on the dry weight of the pulp, for thirty minutes. The extraction stage was effected at a pulp concentration of 12%, a temperature of 55° C., and a sodium hydroxide addition of 0.9%, based on the dry weight of the pulp, for sixty minutes.

Paper was manufactured in the laboratory from the two pulps produced, in accordance with a standard paper making method. Tests made on the tensile strength, the tear strength and the burst index of the paper showed that the pulp produced in accordance with the invention gave, in the main, the same values as the comparison pulp.

This shows that it is possible by the process of the invention to produce a cellulose pulp having a relatively low lignin content and exhibiting good strength properties without the use of chlorine-containing bleaching agents.

Having regard to the foregoing disclosure, the following is claimed as the inventive and patentable embodiments thereof:

1. A process for the bleaching delignification of chemically digested cellulose pulp with oxygen gas in the presence of alkali after activating the pulp with nitrogen dioxide and washing the activated pulp with water or a dilute aqueous solution, which comprises the following steps in the sequence stated:

(1) removing digestion liquor from the pulp by treating the pulp with waste liquor from the oxygen gas bleaching delignification, stage (5), thereby forcing a major part of the waste digestion liquor out of the pulp;

(2) pretreating the resulting pulp with acid wash liquor recovered from washing the pulp after the activating stage (3) at a pulp consistency within the range from about 1 to about 20% at a temperature within the range from about 20° to about 80° C. for a reaction period not exceeding about sixty minutes, these conditions being so selected and controlled that any lowering of the intrinsic viscosity of the pulp in this stage does not exceed 5%;

(3) activating the pretreated pulp with nitrogen dioxide;

(4) washing the activated pulp with a member selected from the group consisting of water and a dilute aqueous solution;

(5) subjecting the washed pulp to bleaching delignification with oxygen gas in the presence of alkali; and (6) thereby obtaining bleached delignified pulp.

2. A process according to claim 1 which comprises washing out a major part of the acid reaction products from the activated pulp, and then impregnating the pulp with waste liquor from the oxygen gas bleaching delignification stage, before subjecting it to the oxygen gas bleaching delignification stage.

3. A process according to claim 1 in which the chemical cellulose pulp is an alkaline digested chemical pulp.

4. A process according to claim 3 in which the alkaline digested pulp is sulfate pulp.

5. A process according to claim 3 in which the alkaline digested pulp is polysulfide pulp.

6. A process according to claim 3 in which the alkaline digested pulp is soda pulp.

7. A process according to claim 1 in which the chemical cellulose pulp is sulfite pulp.

8. A process according to claim 1 in which the pulp after bleaching with oxygen is subjected to a final treatment with chlorine dioxide.

9. A process according to claim 1 which comprises adding to the pulp a complexing agent for polyvalent metals prior to or during the oxygen gas bleaching delignification stage.

10. A process according to claim 9 in which the complexing agent is selected from the group consisting of aminopolyphosphonic acids and aminopolycarboxylic acids.

11. A process according to claim 9 in which the complexing agent is added to the pulp in aqueous solution at a pH below 7.5, and the treatment allowed to proceed for a period of time not exceeding ninety minutes at a temperature within the range from about 20° to about 100° C., the time and temperature being so adjusted that no appreciable reduction in pulp viscosity is obtained.

12. A process according to claim 9 in which at least one complexing agent is added that provides manganese complexes which at pH 9 have a stability constant which is at least 1000 times greater than the corresponding stability constant for magnesium complexes.

13. A process according to claim 1 in which the pulp is activated with nitrogen dioxide for a period within the range from about 5 to about 250 seconds.

14. A process according to claim 9 in which the complexing agent is added prior to or after the activating stage.

15. A process according to claim 14 in which the complexing agent is added after the acid solution is washed from the activated pulp.

16. A process according to claim 9 in which subsequent to treating the cellulose pulp with the complexing agent the pulp is washed, thereby removing complexed polyvalent metals from the pulp.

17. A process according to claim 16 in which the washing is carried out with waste liquor from the oxygen gas bleaching delignification stage.

18. A process according to claim 9 in which complexing is initiated at a pH below 6, and then the pH is raised to within the range from 6.5 to 9 using waste liquor obtained from the oxygen gas bleaching delignification stage.

19. A process according to claim 9 in which the complexing agent introduced is completely removed from the cellulose pulp before the pulp is introduced to the oxygen gas bleaching delignification stage.

20. A process according to claim 19 in which after removing the complexing agent an additional quantity of complexing agent is introduced and permitted to accompany the pulp during the oxygen gas bleaching delignification stage.

21. A process according to claim 1 which comprises adding formaldehyde to the pulp prior to the oxygen gas bleaching delignification stage in an amount up to about 0.5%, based on the dry weight of the pulp.

22. A process according to claim 1 in which the process is repeated one or more times.

23. A process for the bleaching delignification of chemically digested cellulose pulp with oxygen gas in the presence of alkali after activating the pulp with nitrogen dioxide and washing the activated pulp with water or a dilute aqueous solution which comprises (1) digesting wood chips in a digester and forming cellulose pulp impregnated with waste digestion liquor;

(2) washing the pulp with waste oxygen gas bleaching liquor obtained from the oxygen gas bleaching delignification, thereby forcing the major part of the waste digestion liquor out of the pulp;

(3) washing the pulp with waste liquor from previously washed pulp in this stage;

(4) pretreating the pulp with acid waste liquor obtained from the activating stage;

(5) dewatering and pressing the pretreated pulp, and recycling the recovered waste liquor to stage (3);

(6) fluffing the pulp and introducing the pulp into the activating stage;

(7) subjecting the pulp to reduced pressure and introducing gaseous nitrogen dioxide, and activating the pulp therewith;

(8) washing the activated pulp with a member selected from the group consisting of water and a dilute aqueous solution and recycling the waste liquor recovered therefrom in part to the pretreatment stage (4) and in part to the washing stage (3);

(9) impregnating the washed pulp with oxygen gas bleaching waste liquor obtained from oxygen gas bleaching delignification and with waste liquor from stage (10);

(10) dewatering and pressing the resulting pulp suspension and fluffing the pulp and recycling the recovered waste liquor in part to the impregnating stage (9) and in part to the washing stage (2);

(11) subjecting the pulp to oxygen gas bleaching delignification and recycling the recovered waste oxygen gas bleaching liquor in part to stage (2), in part to stage (9), and in part to stage (12); and

(12) diluting the delignified bleached pulp with waste liquor recovered from the oxygen gas bleaching delignification stage (11).

* * * * *